US010167693B2

(12) United States Patent
Minnock et al.

(10) Patent No.: US 10,167,693 B2
(45) Date of Patent: Jan. 1, 2019

(54) HANGER SEALING SYSTEM

(71) Applicant: Cameron International Corporation, Houston, TX (US)

(72) Inventors: Kevin Peter Minnock, Houston, TX (US); Alan Davis, Houston, TX (US)

(73) Assignee: Cameron International Corporation, Houston, TX (US)

( * ) Notice: Subject to any disclaimer, the term of this patent is extended or adjusted under 35 U.S.C. 154(b) by 193 days.

(21) Appl. No.: 15/169,201

(22) Filed: May 31, 2016

(65) Prior Publication Data

US 2017/0342805 A1 Nov. 30, 2017

(51) Int. Cl.

| | |
|---|---|
| ***E21B 33/04*** | (2006.01) |
| *E21B 34/14* | (2006.01) |
| *E21B 33/03* | (2006.01) |

(52) U.S. Cl.

CPC ..... *E21B 33/04* (2013.01); *E21B 33/03* (2013.01); *E21B 34/14* (2013.01)

(58) Field of Classification Search

CPC ..... E21B 33/04

See application file for complete search history.

(56) References Cited

U.S. PATENT DOCUMENTS

| | | | |
|---|---|---|---|
| 4,190,270 | A | 2/1980 | Vanderford |
| 4,455,040 | A | 6/1984 | Shinn |
| 4,757,860 | A | 7/1988 | Reimert |
| 5,070,942 | A | 12/1991 | McInnes |
| 5,174,376 | A | 12/1992 | Singeetham |

FOREIGN PATENT DOCUMENTS

| | | | |
|---|---|---|---|
| EP | 0579393 | A1 | 1/1994 |

OTHER PUBLICATIONS

PCT Partial International Search & Invitation to Pay Additional Fees for PCT Application No. PCT/US2017/034693 dated Aug. 17, 2017; 15 Pages.

PCT International Search Report for PCT Application No. PCT/US2017/034693 dated Oct. 16, 2017; 18 Pages.

*Primary Examiner* — Giovanna C. Wright
*Assistant Examiner* — Kristyn A Hall
(74) *Attorney, Agent, or Firm* — Fletcher Yoder, P.C.

(57) ABSTRACT

A system includes a hanger having a tapered radially-outer surface and a hanger sealing assembly configured to move between an unsealed position and a sealed position in which the hanger sealing assembly seals an annular space between the hanger and a housing of a wellhead. The hanger sealing assembly includes an annular sleeve, a first and second annular seal each comprising a respective tapered radially-inner surface configured to contact the tapered radially-outer surface of the hanger, and an annular seal-engaging sleeve. The annular seal-engaging sleeve is coupled to the first and second annular seals, and movement of the annular sleeve along an axial axis is configured to exert an axial force on the first annular seal, thereby causing the first and second annular seals to move axially and radially outward along the tapered radially-outer surface of the hanger to seal the annular space.

20 Claims, 2 Drawing Sheets

HANGER SEALING SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as various casings, hangers, valves, fluid conduits, and the like, that control drilling and/or extraction operations. In some drilling and production systems, a hanger may be used to suspend strings (e.g., piping) within the well to facilitate extraction of the resource. Such hangers may be disposed within and supported by a housing (e.g., a spool or a bowl) of the wellhead.

When the hanger is within the wellhead, an annular seal may be positioned to form a seal across an annular space between the hanger and the housing of the wellhead. However, typical annular seals and associated components (e.g., sleeves, energizing rings, or the like) may not enable efficient installation and/or retrieval of the annular seal.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present disclosure relate generally to a hanger sealing system that is configured to seal an annular space between a hanger and a body of a wellhead of a mineral extraction system. Certain disclosed embodiments may advantageously provide a simple and/or compact hanger sealing system that is configured to efficiently and effectively seal the annular space between the hanger and the body of the wellhead. In certain embodiments, an annular seal of the hanger sealing system may be retrievable (e.g., removable from the body of the wellhead). In certain embodiments, the hanger may have a configuration that reduces or blocks debris buildup on the hanger.

Figure 1:
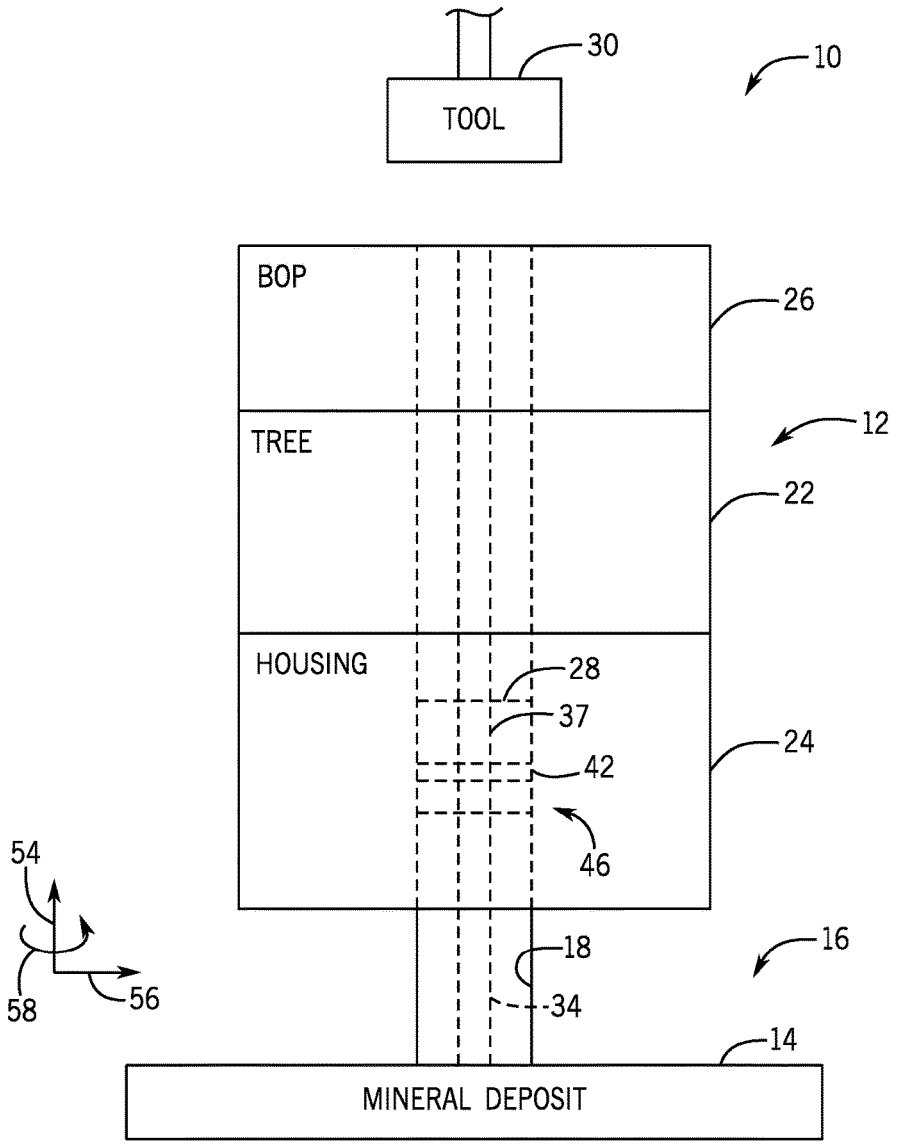
FIG. 1 is a block diagram of a mineral extraction system in accordance with an embodiment of the present disclosure.

With the foregoing in mind, FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or offshore (e.g., an offshore platform system). As illustrated, the system 10 includes a wellhead 12 coupled to a mineral deposit 14 via a well 16. The well 16 includes a well bore 18.

The system 10 may include multiple components that control and regulate activities and conditions associated with the well 16. For example, a tree 22, a housing 24 (e.g., a tubing spool and/or a casing spool), and/or a pressure controlling system 26 (e.g., a BOP, diverters, spacers, risers, adapters, and the like) may also be included as a part of the mineral extraction system 10. The system 10 may include other devices that are coupled to the wellhead 12, and devices that are used to assemble and control various components of the wellhead 12. For example, in the illustrated embodiment, the system 10 includes a hanger running tool 30 that may be used to lower and/or to install a hanger 28 within the wellhead 12. The hanger 28 may be disposed within the wellhead 12 to secure tubing and casing suspended in the well bore 18, and to provide a path for hydraulic control fluid, chemical injections, and so forth. The hanger 28 includes a hanger bore 32 that extends through the center of the hanger 28, and that is in fluid communication with and provides pressure integrity with a tubing string 34 during an installation phase.

As will be appreciated, the well bore 18 may contain elevated pressures. For example, the well bore 18 may include pressures that exceed 10,000, 15,000, or even more pounds per square inch (psi). Accordingly, the mineral extraction system 10 may employ various mechanisms, such as seals, plugs, and valves, to control and regulate the well 16. As discussed in more detail below, in certain embodiments, an annular seal assembly 42 may be provided in an annular space between the hanger 28 and the housing 24 of the wellhead 12. Together, the hanger 28 and the annular seal assembly 42 may form a hanger sealing system 46 that is configured to seal the annular space between the hanger 28 and the housing 24. To facilitate discussion the mineral extraction system 10 of FIG. 1, and the components therein, may be described with reference to an axial axis or direction 54, a radial axis or direction 56, and a circumferential axis or direction 58.

Figure 2:
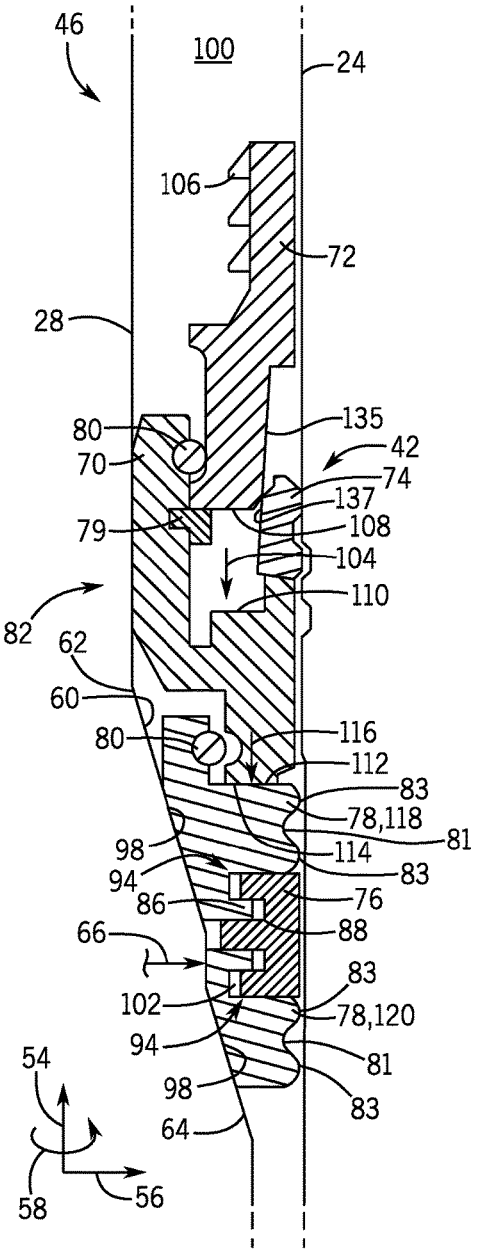
FIG. 2 is a cross-section of an embodiment of a hanger sealing system that may be used to seal an annular space between a hanger and a body of a wellhead of the mineral extraction system of FIG. 1.

FIG. 2 is a cross-section of an embodiment of the hanger sealing system 46 that may be used in the mineral extraction system 10. The hanger sealing system 46 includes the hanger 28 and the annular sealing assembly 42. As shown, the hanger 28 includes a tapered radially-outer surface 60 (e.g., tapered annular surface or conical surface), which is inclined or tapered from an upstream portion 62 to a downstream portion 64 (e.g., along the axial axis 54). Thus, an outer diameter 66 of the hanger 28 increases from the upstream portion 62 to the downstream portion 64.

As shown, the annular sealing assembly 42 includes an inner sleeve 70 (e.g., annular inner sleeve), an outer sleeve 72 (e.g., annular outer sleeve), a locking ring 74 (e.g., annular locking ring), a seal-engaging sleeve 76 (e.g., annular seal-engaging sleeve), multiple seals 78 (e.g., annular seals), a shear ring 79 (e.g., annular shear ring), and one or more retainers 80 (e.g., annular retainers or wires). In the illustrated embodiment, two physically separate (e.g., separated from one another along the axial axis 54) seals 78 are provided. Each of the seals 78 includes a radially-outer surface 81 that contacts the housing 24. As shown, the radially-outer surface 81 includes multiple curves 83 (e.g., alternating curves extending along the axial axis 54). However, any suitable number of seals 78 (e.g., 1, 2, 3, 4, or more) may be provided in the annular sealing assembly 42. The seals 78 may be formed from a corrosion resistant material, such as metals, metal alloys, ceramics, elastomer, or any combination thereof, for example.

In the illustrated embodiment, the seal-engaging sleeve 76 is positioned between the seals 78 along the axial axis 54. As shown, the seal-engaging sleeve 76 is configured to mechanically couple the seals 78 to one another. For example, in some embodiments, a key-slot interface 94 is provided between each of the seals 78 and the seal-engaging sleeve 76. The key-slot interface 94 may be configured to enable a range of radial movement of the seals 78 with respect to the seal-engaging sleeve 76, while maintaining coupling of the seals 78 and the seal-engaging sleeve 76. The key-slot interfaces 94 include a key 86 (e.g., pin or radially-extending protrusion) and a corresponding slot 88 (e.g., recess or radially-extending recess). The key 86 may be inserted into or engage the slot 88 such that the key 86 and the slot 88 overlap along the radial axis 56 to block axial movement of the seal 78 relative to the seal-engaging sleeve 76. In certain embodiments, the key-slot interface 94 may extend about an entirety of the circumference of the seal 78 and the seal-engaging sleeve 76 (e.g., annular key and annular slot). In certain embodiments, one or more key-slot interfaces 94 may be positioned at discrete locations about the circumference of the seal 78 and the seal-engaging sleeve 76 and may extend about a portion of the circumference of the seal 78 and the seal-engaging sleeve 76. For example, in certain embodiments, the key-slot interface 94 may include a bayonet mount or a J-slot to facilitate coupling the seal 78 to the seal-engaging sleeve 76. As noted above, the hanger 28 includes the tapered radially-outer surface 60. Each of the seals 78 has a corresponding or mating tapered radially-inner surface 98 (e.g., tapered annular surface or conical surface) configured to contact the tapered radially-outer surface 60 of the hanger 28.

As shown, the hanger sealing assembly 46 is in a first position 82 (e.g., unsealed position) in which the seals 78 do not contact the housing 24 and/or do not seal an annular space 100 between the hanger 28 and the housing 24. While the hanger sealing assembly 42 is in the first position 82, radial gaps 102 (e.g., extending along the radial axis 56) may be provided between the seals 78 and the seal-contacting sleeve 76. To install the hanger sealing assembly 42 and to seal the annular space 100, the components of the hanger sealing assembly 42 are driven axially in the downstream direction, as shown by arrow 104. For example, a tool (e.g., the tool 30) may engage threads or protrusions 106 of the outer sleeve 72 (e.g., via a quarter or half turn). The tool may drive the outer sleeve 72 axially in the downstream direction, causing the shear ring 79 to shear or to break, and the outer sleeve 72 may move axially relative to the inner sleeve 70 until a contacting surface 108 (e.g., axially-facing annular surface) of the outer sleeve 72 contacts a contacting surface 110 (e.g., axially-facing annular surface) of the inner sleeve 70. Upon contact between the contacting surfaces 108, 110, further axial movement of the outer sleeve 72 drives the inner sleeve 70 axially in the downstream direction. The inner sleeve 70 has a second contacting surface 112 (e.g., axially-facing annular surface) that contacts a contacting surface 114 (e.g., axially-facing annular surface) of the seal 78. Thus, further axial movement of the outer sleeve 72 and the inner sleeve 70 exerts an axial force 116 on the upper seal 78, 118 (e.g., axially in the downstream direction). Because the hanger 28 includes the tapered radially-outer surface 60 and each of the seals 78 includes the mating tapered radially-inner surface 98, the seals 78 move radially outward toward the housing 24 when the axial force 116 is exerted on the upper seal 78, 118 by the inner sleeve 70. Additionally, the seal-engaging sleeve 76 couples the seals 78 to one another and transfers the axial force 116 to the lower seal 78, 120. As the seals 78 move radially outward toward the housing 24, a radial distance across the radial gaps 102 may be reduced or the radial gaps 102 may be eliminated.

Figure 3:
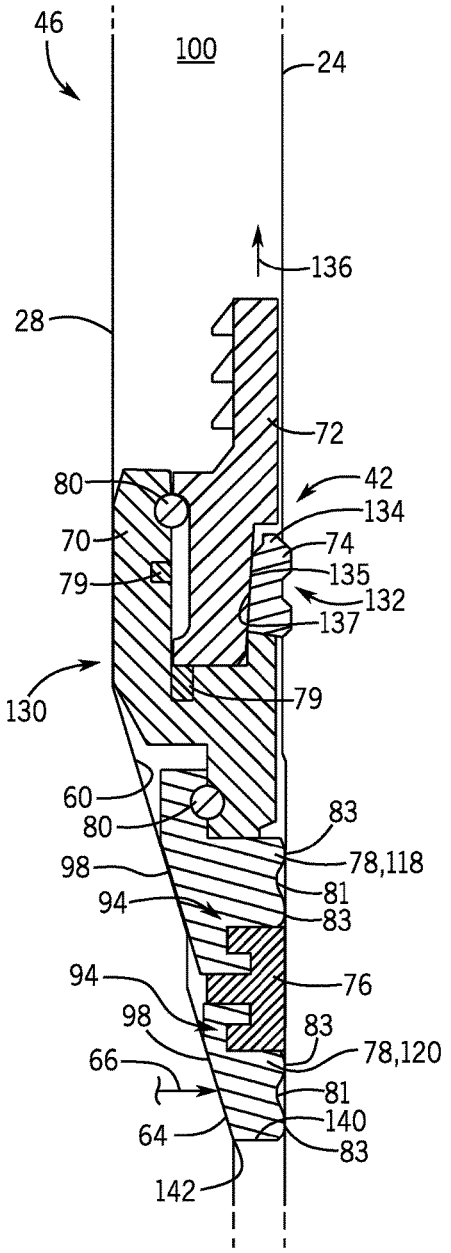
FIG. 3 is a cross-section of the hanger sealing system of FIG. 2 with an annular seal in a sealed position.

FIG. 3 is a cross-section of an embodiment of the hanger sealing assembly 42 in a second position 130 (e.g., sealed position) in which the seals 78 contact the housing 24 and/or seal (e.g., block fluid flow) the annular space 100 between the hanger 28 and the housing 24. As discussed above, to move the hanger sealing assembly 42 from the unsealed position 82 shown in FIG. 2 to the sealed position 130 shown in FIG. 3, a tool (e.g., tool 30) may be used to urge the outer sleeve 72 axially in the downstream direction. Axial movement of the outer sleeve 72 eventually causes the shear ring 79 to shear and the inner sleeve 70 to exert the axial force 116 on the upper seal 78, 118. Because the hanger 28 includes the tapered radially-outer surface 60 and each of the seals 78 includes the mating tapered radially-inner surface 98, the seals 78 move radially outward toward the housing 24 in response to the axial force 116. As shown, the seal-engaging sleeve 76 couples the seals 78 to one another and transfers the axial force 116 to the lower seal 78, 120. In the illustrated embodiment, a radial distance across the radial gaps 102 is reduced or the radial gaps 102 are eliminated when the hanger sealing assembly 42 is in the sealed position 130. As shown, the locking ring 74 is in a locked position 132 within a corresponding recess 134 of the housing 24. As the hanger sealing assembly 42 is moved into the sealed position 130, the locking ring 74 may be driven axially downward and radially outward into the corresponding recess 134 via contact with the outer sleeve 72. In certain embodiments, a radially-outer surface 135 (e.g., tapered annular surface or conical surface) of the outer sleeve 72 contacts a corresponding radially-inner surface 137 (e.g., tapered annular surface or conical surface) 139 of the locking ring 74, thereby driving the locking ring 74 into the locked position 132. The shear ring 79 may block the outer sleeve 72 from prematurely setting or driving the locking ring 74 into the locked position 132 within the corresponding recess 134 of the housing 24.

In certain embodiments, the hanger sealing assembly 42 may be retrievable (e.g., moves from the sealed position 130 to the unsealed position 84 and/or removed from the wellhead 12). The inner sleeve 70, the outer sleeve 72, the seals 78, and the seal-engaging sleeve 76 may be mechanically coupled or linked such that movement of the outer sleeve 72 axially in the upstream direction, as shown by arrow 136, causes the seals 78 to move axially in the upstream direction and to separate from the housing 24 to reach the unsealed position 82. For example, in the illustrated embodiment, the outer sleeve 72 and the inner sleeve 70 are coupled via a retainer 80, and the inner sleeve 70 and the upper seal 78, 118 are coupled via a retainer 80. The one or more retainers 80 may have any suitable form for coupling the components to one another. For example, as shown, the one or more retainers 80 is a wire that extends circumferentially about all or a portion of one component and engages another component. In some embodiments, the one or more retainers 80 may be a fastener (e.g., threaded fastener), a key-slot interface, or the like. The one or more retainers 80 may extend about an entirety of the circumference of the respective component (e.g., seal 78, inner sleeve 70, outer sleeve 72). In certain embodiments, one or more retainers 80 may be positioned at discrete locations about the circumference of the respective component and may extend about a portion of the circumference of the respective component, thereby coupling the components together at the discrete locations.

In the illustrated embodiment, the seal-engaging sleeve 76 is coupled to the upper seal 78, 118 via a respective key-slot interface 94, and the lower seal 78, 120 is coupled to the seal-engaging sleeve 76 via a respective key-slot interface 94. Thus, the hanger sealing assembly 42 is configured to move axially as a unit. Such a configuration may enable the hanger sealing assembly 42 to be efficiently adjusted or removed from the wellhead 12, such as for inspection, repair, or replacement, and/or without removing the hanger 12 from the wellhead 12.

In certain embodiments, in the sealed position 130, the lower seal 78, 120 is supported by and/or is wedged between the tapered radially-outer surface 60 of the hanger 28 and the housing 24. As shown, a lower surface 140 (e.g., axially-facing annular surface) of the lower seal 78, 120 is not supported by or does not contact the hanger 28. The hanger 28 does not include a shoulder or an axially-facing surface extending radially outward from the downstream portion 64 of the hanger 28 and toward the housing 24 that is configured to contact, support, and/or block further axial movement of the lower seal 78, 120. For example, as shown, an outer surface of the hanger 28 turns to extend axially from a downstream end 142 of the tapered radially-outer surface 60, and the downstream end 142 of the tapered radially-outer surface 60 has the largest outer diameter 66 of the hanger 28 along a length of the hanger 28 that extends along the hanger sealing assembly 42 and below (e.g., downstream) of the hanger sealing assembly 42. Such a configuration may advantageously reduce debris buildup on the hanger 28 and reduce the incidence of debris interfering with movement of the hanger sealing assembly 42.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a hanger having a tapered radially-outer surface;

a hanger sealing assembly configured to move between an unsealed position and a sealed position in which the hanger sealing assembly seals an annular space between the hanger and a housing of a wellhead, wherein the hanger sealing assembly comprises:

an annular sleeve configured to move along an axial axis within the annular space;

a first annular seal and a second annular seal each positioned downstream of the annular sleeve relative to a well and each comprising a respective tapered radially-inner surface configured to contact the tapered radially-outer surface of the hanger; and an annular seal-engaging sleeve positioned between the first annular seal and the second annular seal along the axial axis, wherein the annular seal-engaging sleeve is mechanically coupled to the first annular seal and to the second annular seal, and movement of the annular sleeve along the axial axis is configured to exert an axial force on the first annular seal, thereby causing the first annular seal and the second annular seal to move axially and radially outward along the tapered radially-outer surface of the hanger to seal the annular space.

2. The system of claim 1, wherein the first annular seal and the second annular seal are retrievable from the sealed position.

3. The system of claim 1, wherein a radial gap extends between the annular seal-engaging sleeve and at least one of the first annular seal and the second annular seal while the hanger sealing assembly is in the unsealed position.

4. The system of claim 3, wherein a radial distance across the radial gap is reduced while the hanger sealing assembly is in the sealed position.

5. The system of claim 1, wherein the annular seal-engaging sleeve is coupled to the first annular seal and the second annular seal via a key-slot interface.

6. The system of claim 1, wherein the annular sleeve and the first annular seal are coupled to one another via a retainer that facilitates retrieval of the first annular seal from the sealed position.

7. The system of claim 1, wherein the tapered radially-outer surface includes an upstream end having a first diameter and a downstream end having a second diameter greater than the first diameter, a lower outer surface of the hanger extends axially from the downstream end of the tapered radially-outer surface of the hanger, and the second diameter is the largest diameter of the hanger downstream of the first annular seal to reduce debris buildup on the hanger.

8. The system of claim 1, comprising a locking ring configured to engage a corresponding recess of the housing to block axial movement of the hanger sealing assembly relative to the housing.

9. The system of claim 1, wherein the first annular seal and the second annular seal are movable along a radial path of travel relative to the annular seal-engaging sleeve while mechanically coupled together, and the annular seal-engaging sleeve blocks movement of the first annular seal and the second annular seal along an axial path of travel relative to the annular seal-engaging sleeve while mechanically coupled together.

10. A system, comprising:

a hanger having a tapered radially-outer surface;

a hanger sealing assembly configured to move between an unsealed position and a sealed position in which the hanger sealing assembly seals an annular space between the hanger and a housing of a wellhead, wherein the hanger sealing assembly comprises:

an annular sleeve configured to move along an axial axis within the annular space;

a first annular seal comprising a respective tapered radially-inner surface configured to contact the tapered radially-outer surface of the hanger and coupled to the annular sleeve via a retainer;

a second annular seal physically separated from the first annular seal along the axial axis and comprising a respective tapered radially-inner surface configured to contact the tapered radially-outer surface of the hanger; and an annular seal-engaging sleeve positioned between the first annular seal and the second annular seal along the axial axis, wherein the annular seal-engaging sleeve blocks movement of the first annular seal and the second annular seal along an axial path of travel relative to the annular seal-engaging sleeve while the annular seal-engaging sleeve is mechanically coupled to the first annular seal and the second annular seal, and wherein the first annular seal, the second annular seal, and the annular seal-engaging sleeve are retrievable from the sealed position via movement of the annular sleeve along the axial axis in an upstream direction.

11. The system of claim 10, wherein the first annular seal and the second annular seal are movable along a radial path of travel relative to the annular seal-engaging sleeve while the annular seal-engaging sleeve is mechanically coupled to the first annular seal and the second annular seal, and a radial gap extends between the annular seal-engaging sleeve and at least one of the first annular seal and the second annular seal while the hanger sealing assembly is in the unsealed position.

12. The system of claim 11, wherein a radial distance across the radial gap is reduced while the hanger sealing assembly is in the sealed position.

13. The system of claim 10, wherein the annular seal-engaging sleeve is coupled to the first annular seal and to the second annular seal via respective key-slot interfaces.

14. The system of claim 10, wherein the tapered radially-outer surface includes an upstream end having a first diameter and a downstream end having a second diameter greater than the first diameter, and a lower outer surface of the hanger extends axially from the downstream end of the tapered radially-outer surface of the hanger to reduce debris buildup on the hanger proximate to the hanger sealing assembly.

15. The system of claim 10, wherein movement of the annular sleeve along the axial axis in a downstream direction within the annular space exerts a force on the first annular seal, thereby causing the first annular seal and the second annular seal to move together axially in the downstream direction and radially outward along the tapered radially-outer surface of the hanger until the hanger sealing assembly reaches the sealed position in which the first annular seal and the second annular seal form respective seals against the tapered radially-outer surface of the hanger and the housing of the wellhead.

16. A hanger sealing system, comprising:

a first annular seal having a tapered radially-inner surface; and a hanger having a tapered radially-outer surface configured to contact the tapered radially-inner surface of the first annular seal to facilitate driving the first annular seal radially outward to seal an annular space between the hanger and a housing of a wellhead, wherein the tapered radially-outer surface includes an upstream end having a first diameter and a downstream end having a second diameter greater than the first diameter, a lower outer surface of the hanger extends axially from the downstream end of the tapered radially-outer surface of the hanger, and the second diameter is the largest diameter of the hanger downstream of the first annular seal to reduce debris buildup on the hanger.

17. The system of claim 16, comprising a second annular seal physically separated from the first annular seal along an axial axis of the hanger sealing system.

18. The system of claim 17, comprising an annular seal-engaging sleeve positioned between the first annular seal and the second annular seal along the axial axis and coupled to the first annular seal and to the second annular seal via respective key-slot interfaces.

19. The system of claim 17, comprising an annular seal-engaging sleeve positioned between the first annular seal and the second annular seal along the axial axis and mechanically coupled to the first annular seal and to the second annular seal, wherein the annular seal-engaging sleeve enables the first annular seal and the second annular seal to move radially relative to the annular seal-engaging sleeve and blocks the first annular seal and the second annular seal from moving axially relative to the annular seal-engaging sleeve when mechanically coupled to the first annular seal and to the second annular seal.

20. The system of claim 16, comprising an annular sleeve positioned upstream of the first annular seal along an axial axis of the hanger sealing assembly and coupled to the first annular seal, wherein the first annular seal is retrievable from a sealed position within the wellhead by moving the annular sleeve along an axial axis relative to the hanger.

* * * * *